US010597174B2

(12) United States Patent
Seno et al.

(10) Patent No.: US 10,597,174 B2
(45) Date of Patent: Mar. 24, 2020

(54) FILLING NOZZLE

(71) Applicant: SHIBUYA CORPORATION, Ishikawa (JP)

(72) Inventors: Tetsuya Seno, Ishikawa (JP); Masato Ohta, Ishikawa (JP)

(73) Assignee: SHIBUYA CORPORATION, Ishikawa (JP)

( * ) Notice: Subject to any disclaimer, the term of this patent is extended or adjusted under 35 U.S.C. 154(b) by 126 days.

(21) Appl. No.: 15/850,287

(22) Filed: Dec. 21, 2017

(65) Prior Publication Data

US 2018/0178931 A1 Jun. 28, 2018

(30) Foreign Application Priority Data

Dec. 22, 2016 (JP) ..... 2016-249354

(51) Int. Cl.

| | |
|---|---|
| ***B65B 1/16*** | (2006.01) |
| ***B65B 1/12*** | (2006.01) |
| ***B65B 39/02*** | (2006.01) |
| ***B65B 39/12*** | (2006.01) |

(52) U.S. Cl.

CPC ..... *B65B 1/16* (2013.01); *B65B 1/12* (2013.01); *B65B 39/02* (2013.01); *B65B 39/12* (2013.01); *B65B 2210/10* (2013.01)

(58) Field of Classification Search

CPC .... B65B 1/16; B65B 1/10; B65B 1/04; B65B 1/30; B65B 39/12

See application file for complete search history.

(56) References Cited

U.S. PATENT DOCUMENTS 3,616,968 A * 11/1971 James ..... B65B 1/30 222/643
3,664,385 A 5/1972 Carter
5,727,607 A * 3/1998 Ichikawa ..... B65B 1/16 141/374
5,921,295 A 7/1999 Zelazny et al.
(Continued)

FOREIGN PATENT DOCUMENTS

DE 19805437 8/1999
DE 102005033869 1/2007
(Continued)

OTHER PUBLICATIONS

Official Communication issued in European Patent Office (EPO) Patent Application No. 17208890.8, dated Mar. 26, 2018.

*Primary Examiner* — Reinaldo Sanchez-Medina
(74) *Attorney, Agent, or Firm* — Greenblum & Bernstein, P.L.C.

(57) ABSTRACT

A filling nozzle provided with a filling cylinder, an air-injection cylinder, and an air-supply unit. The filling cylinder is configured such that an auger rotates about the axis thereof to discharge powder through an opening provided at the lower end of the filling cylinder. The air-injection cylinder is fitted to the exterior of the filling cylinder to form an annular space between the filling cylinder and the air-injection cylinder. The air-supply unit supplies air in the annular space. A tip portion of the air-injection cylinder extends downward below the opening and has an air-discharge mouth formed in a tapered shape such that the tip portion has a diameter smaller than that of the opening.

4 Claims, 4 Drawing Sheets

(56) References Cited

U.S. PATENT DOCUMENTS

| | | | | |
|---|---|---|---|---|
| 5,988,234 | A * | 11/1999 | Wegman | B65B 1/12 141/286 |
| 6,098,677 | A | 8/2000 | Wegman et al. | |
| 6,102,088 | A * | 8/2000 | Wegman | B65B 1/12 141/256 |
| 6,179,015 | B1 * | 1/2001 | Kammler | B65B 9/20 141/4 |
| 6,318,418 | B1 | 11/2001 | Grossmann et al. | |
| 6,340,036 | B1 * | 1/2002 | Toyoizumi | B65B 1/12 141/275 |
| 6,378,270 | B1 * | 4/2002 | Araki | B65B 1/16 241/260.1 |
| 6,640,845 | B1 * | 11/2003 | Wegman | B65B 1/12 141/59 |
| 2008/0308647 | A1 * | 12/2008 | Maget | A01M 1/2044 239/34 |

FOREIGN PATENT DOCUMENTS

| | | |
|---|---|---|
| EP | 0900732 | 3/1999 |
| JP | 2001-139152 | 5/2001 |
| JP | 5195037 | 2/2013 |

* cited by examiner

FILLING NOZZLE

BACKGROUND OF THE INVENTION

1. Field of the Invention

The present invention relates to a filling nozzle that fills powder in a container, using an auger.

2. Description of the Related Art

Conventionally, there is known a filling nozzle having an auger, which is disclosed in Japanese Patent Publication No. 5195037. In the filling nozzle, the amount of rotation of the auger is adjusted to control the filling amount of powder into the container. Especially when filling wet powder into a container, a problem occurs, in which the powder adheres to a tip portion of the filling nozzle, causing a reduction in the filling amount. On the other hand, as a device for preventing the powder from adhering to the filling nozzle, there is known a filling nozzle disclosed in Japanese Unexamined Patent Publication No. 2001-139152. This device is provided with a nozzle composed of porous plastic, which is attached to a portion under the auger, so that air flow is generated on an inner surface of the nozzle by compressed air supplied from the outside, which prevents the powder from adhering to an inner surface of the nozzle.

According to the device of JUPP No. 2001-139152, if small holes of porous plastic are plugged by powder, a problem occurs, in which the supply of compressed air becomes insufficient and thus powder adheres to the inner surface of the nozzle. Further, high-pressure air is required in order to pass the compressed air through the porous plastic, and thus, a high performance and expensive pressure source would need to be provided. Furthermore, when the air is highly pressurized, a problem may occur, in which powder is not supplied into the container, but blows upward instead.

SUMMARY OF THE INVENTION

An object of the present invention is to provide a filling nozzle, which uses low-pressure air in comparison with a prior device to prevent the powder from adhering to the inner surface of the nozzle, and in which the structure is simple and inexpensive.

According to the present invention, there is provided a filling nozzle comprising a filling cylinder, in which an auger rotates about the axis thereof to discharge powder from an opening provided at the lower end of the filling cylinder, an air-injection cylinder, and an air-supply unit. The air-injection cylinder is fitted to the exterior of the filling cylinder to form an annular space between the filling cylinder and the air-injection cylinder. The air-supply unit supplies air in the annular space. The air-injection cylinder has a tip portion that extends downward below the opening and has an air-discharge mouth formed in a tapered shape such that the tip portion has a diameter smaller than that of the opening.

An inner surface of the air-discharge mouth may be coated with a water-repellant layer.

The filling nozzle may further comprise a lifting unit that raises and lowers the air-injection cylinder relative to the filling cylinder. The lifting unit lowers the air-injection cylinder such that the tip of the air-injection cylinder is inserted into a container when the filling cylinder discharges powder from the opening to supply the powder into the container.

BRIEF DESCRIPTION OF THE DRAWINGS

The object and advantages of the present invention will be better understood from the following description, with reference to the accompanying drawings in which.

DESCRIPTION OF THE PREFERRED EMBODIMENTS

Figure 1:
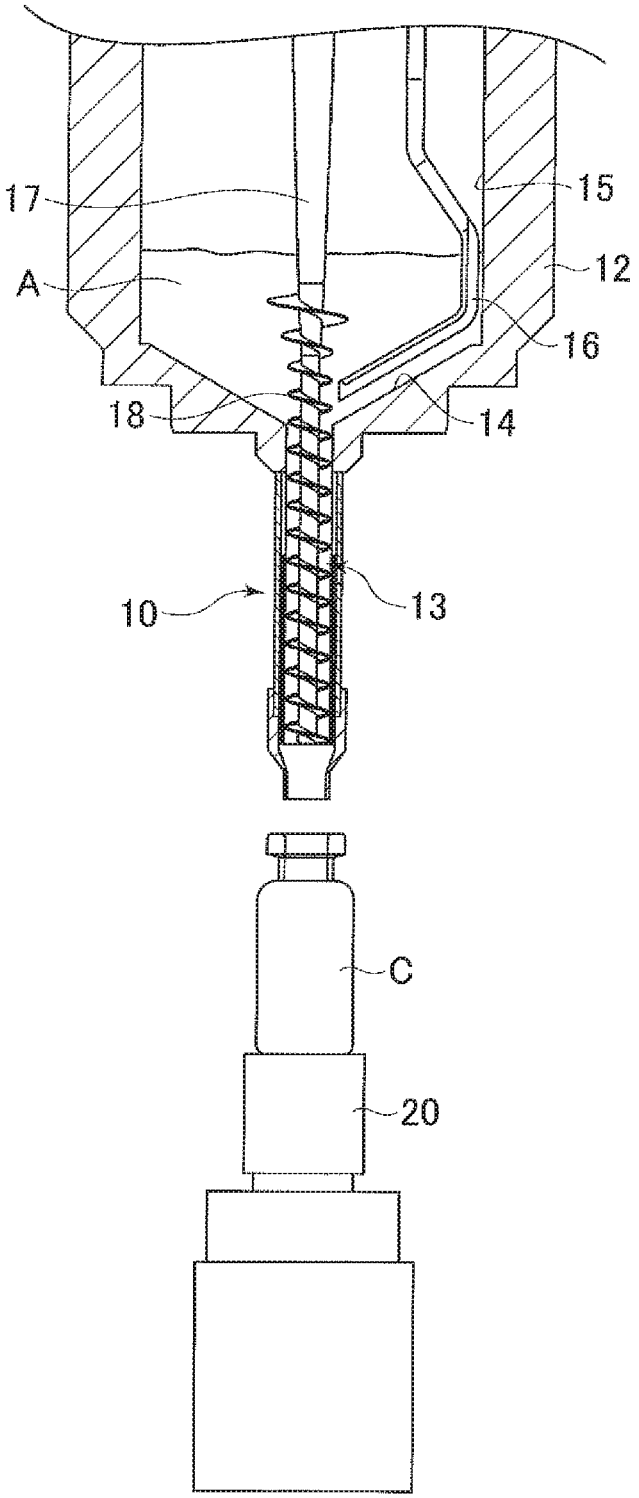
FIG. 1 is a sectional view showing a powder filling device having a filling nozzle, which is a first embodiment of the present invention.

In the following, the present invention will be described with reference to an embodiment shown in the drawings.

FIG. 1 shows a powder filling device having a filling nozzle 10, which is a first embodiment of the present invention. A container C is intermittently conveyed by a conveyor 20 in a direction perpendicular to a paper plane, and stopped directly under the filling nozzle 10, where the container C is filled with powder A supplied through the filling nozzle 10.

The filling nozzle 10 is attached to a lower surface of a storage chamber 12, which is a tank for reserving the powder A, and is extended vertically downward to the conveyer 20. An auger 13 is provided at the center of the storage chamber 12, and is vertically extended. The auger 13 has a rotary shaft 17 and a helical member 18 formed on an outer surface of the rotary shaft 17. An upper end of the rotary shaft 17 is connected to a rotating drive source not shown, and a lower end of the rotary shaft 17 is extended to a portion close to the lower end of the filling nozzle 10. The helical member 18 is continuously formed from the inside of the storage chamber 12 to the lower end of the rotary shaft 17. The auger 13 is controlled by a controller not shown, which stores, in advance, data of a relationship between the filling amount of the container C and the number of rotations of the auger 13, to control the rotation of the auger 13 in accordance with the filling amount.

A bottom surface 14 of the storage chamber 12 is a conical surface, which is inclined such that it is lowered toward the center. A stirring blade 16 is provided in the storage chamber 12, and is extended along an inner wall 15 of the storage chamber 12 and the bottom surface 14. The stirring blade 16 is fixed to a base portion (not shown) of the auger 13, to integrally rotate with the auger 13.

Figure 2:
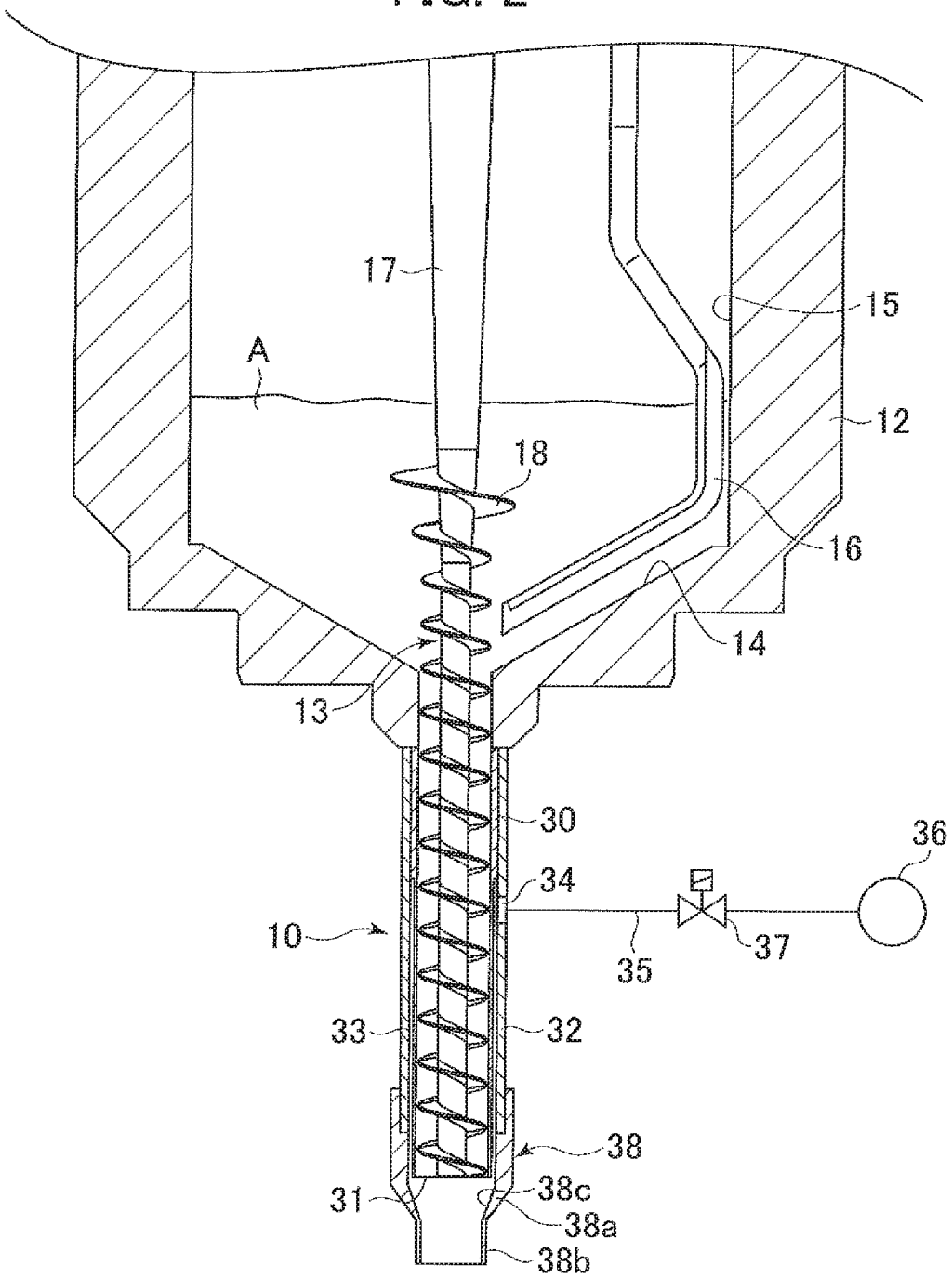
FIG. 2 is a sectional view showing the filling nozzle.
Figure 3:
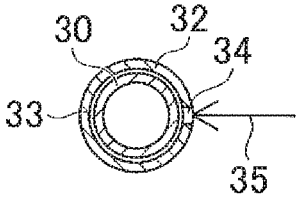
FIG. 3 is a sectional view of the filling nozzle along a horizontal plane at the air inlet hole of the filling nozzle.

With reference to FIGS. 2 and 3, the structure of the filling nozzle 10 will be described below.

A filling cylinder 30 is fixed to an outer surface of a lower end of the storage chamber 12, and extended vertically downward. The auger 13 is extended along the axis of the filling cylinder 30, and the lower end portion of the auger 13 reaches an opening 31 provided at the lower end of the filling cylinder 30. The auger 13 rotates about the axis thereof, so that the powder A reserved in the storage 12 is forced downward by the helical member 18 and discharged through the opening 31.

An air-injection cylinder 32 is fitted to the exterior of the filling cylinder 30, in which an upper portion close to the storage chamber 12 is relatively thick walled, and a lower portion under the upper portion is relatively thin walled, such that an annular space 33 is formed between the filling cylinder 30 and the air-injection cylinder 32. In the air-injection cylinder 32, a portion corresponding to the thin walled portion of the filling cylinder 30 is formed with an air-leading hole 34, which is connected to a compressed air source (air-supply unit) 36 through an air-supply passage 35. A valve 37 is provided to the air-supply passage 35 to turn on and off the supply of compressed air from the compressed air source 36 to the annular space 33. Note that a plurality of air-leading holes 34 may be provided.

An air-discharge mouth 38 is fitted at a tip portion of the air-injection cylinder 32, and extends downward below the opening 31 of the air-injection cylinder 32. The air-discharge mouth 38 has a conical portion 38*a*, which is located under the opening 31 and is formed in a tapered shape such that the lower end of the conical portion 38*a* has a diameter smaller than that of the opening 31. A cylindrical portion 38*b* is formed at the tip of the conical portion 38*a*. It is preferable that an inner surface 38*c* of the conical portion 38*a* of the air-discharge mouth 38 is coated with a water-repellant layer.

An operation of the embodiment will be described below.

When a container C is conveyed to a place directly under the filling nozzle 10 by the conveyor 20, the auger 13 and the stirring blade 16 are integrally rotated. Due to this, the powder A reserved in the storage chamber 12 is stirred by the stirring blade 16 into the filling cylinder 30 through the helical member 18. Thus, the powder A is discharged from the opening 31 and supplied into the container C. When the auger 13 and the stirring blade 16 are rotated, the valve 37 is opened, and thus compressed air is injected into the annular space 33 from the compressed air source 36. The compressed air is injected from the lower end of the annular space 33 to the air-discharge mouth 38 and flows along the inner surface 38*c* until it is discharged from the cylindrical portion 38*b*. Thus, since the air flow occurs throughout the entire area of the tapered inner surface 38*c* of the air-discharge mouth 38, the powder A hardly adheres to the inner surface 38*c*, and is smoothly supplied into the container C.

When the amount of rotations of the auger 13 reaches the value corresponding to the amount of the powder A to be filled into the container C, the controller stops the rotations of the auger 13 and the stirring blade 16. Then, when a predetermined time has passed, the valve 37 is closed, and thus the injection of the compressed air into the annular space 33 is stopped. The conveyor 20 is then driven to convey the container C to the next process.

In the first embodiment, as described above, in the filling operation of the powder A into the container by the filling nozzle 10, compressed air is injected to flow along the taper or inclination of the inner surface 38*c* of the air-discharge mouth 38. Therefore, the powder A does not adhere to the inner surface 38*c*, and thus, even when wet powder A is filled in the container C, the powder is prevented from adhering to the inner surface 38*c*, so that the filling operation for the container C can be smoothly performed.

Since the compressed air flows along the inner surface 38*c* of the air-discharge mouth 38, it is not necessary to use highly compressed air as in a prior art, and thus the structure of the filling nozzle 10 is simple and inexpensive.

Note that, in the first embodiment, the filling operation is stopped when the number of rotations of the auger 13 reaches a predetermined value. However, it is possible to mount a scale or weighing machine at the filling position with the container C placed on the scale so that the filling operation is carried out while measuring the weight, and when a predetermined weight is measured, the auger 13 is controlled to stop the rotation.

Figure 4:
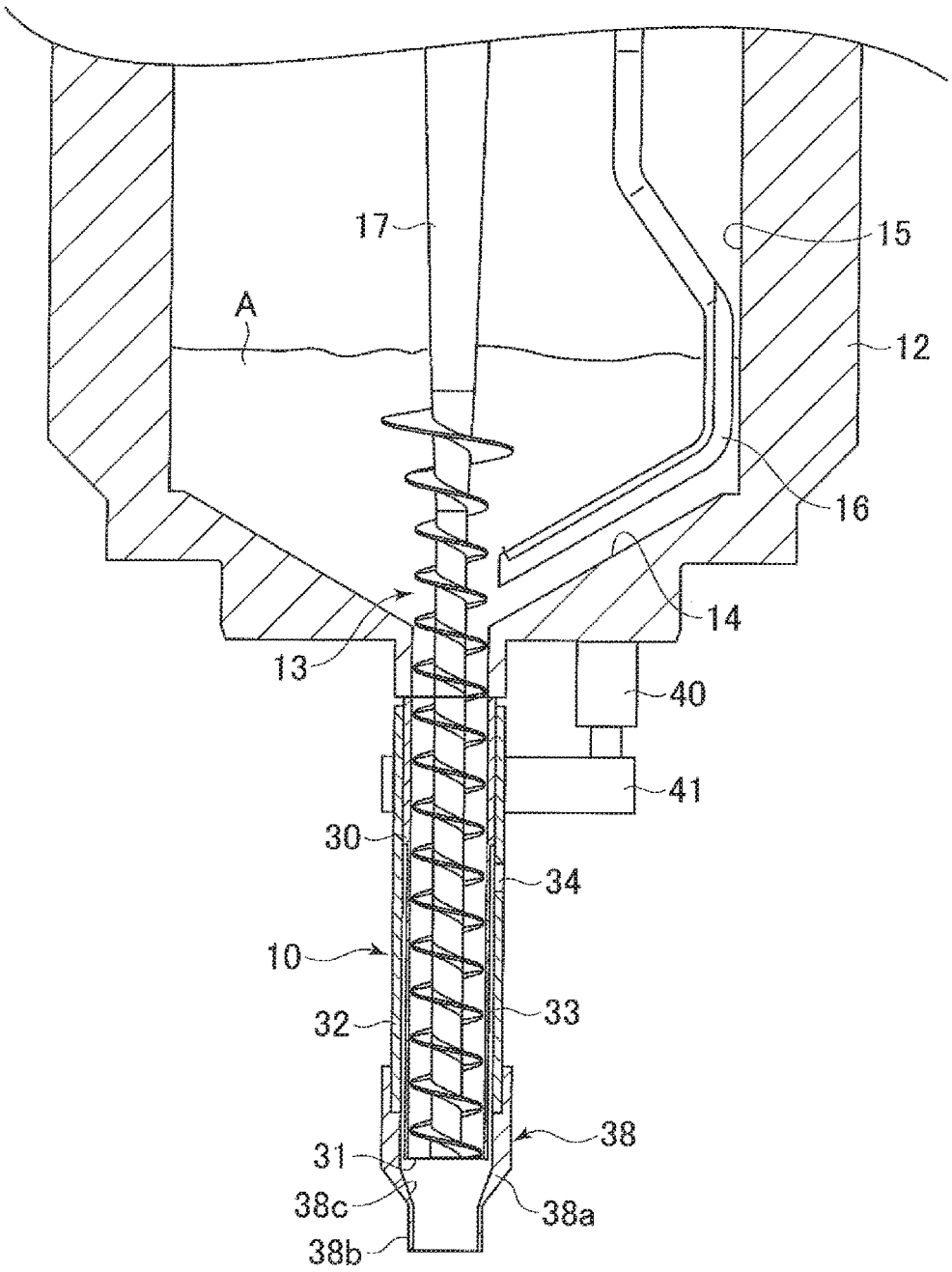
FIG. 4 is a sectional view showing a filling nozzle, which is a second embodiment of the present invention.

FIG. 4 shows a filling nozzle 10 of a second embodiment.

The difference of second embodiment from the first embodiment is that the air-injection cylinder 32 can be raised and lowered relative to the filling cylinder 30. That is, a lifting cylinder or lifting unit 40 is attached to an outer surface of a lower portion of the storage chamber 12, and a connecting member 41 fixed to the piston of the lifting cylinder 40 is connected to an outer surface of the air-injection cylinder 32. The lifting cylinder 40 lowers the piston such that the air-injection cylinder 32 descends relative to the filling cylinder 30, and the tip of the air-injection cylinder 32 is inserted into the container C when the filling cylinder 30 discharges the powder A from the opening 31 to supply the powder A into the container C. According to this construction, the powder A ejected from the opening 31 of the filling cylinder 30 does not escape outside the container C, and is supplied in its entirety into the container C.

The present disclosure relates to subject matter contained in Japanese Patent Application No. 2016-249354 (filed on Dec. 22, 2016) which is expressly incorporated herein, by reference, in its entirety.

The invention claimed is:

1. A filling nozzle comprising:

a filling cylinder, in which an auger rotates about the axis of the filling cylinder to discharge powder through an opening provided at the lower end of the filling cylinder;

an air-injection cylinder fitted to the exterior of the filling cylinder to form an annular space between the filling cylinder and the air-injection cylinder; and an air-supply unit supplying air in the annular space, the supplied air passing through the annular space;

the air-injection cylinder having a tip portion that extends downward below the opening and has an air-discharge mouth formed in a tapered shape such that the tip portion has a diameter smaller than that of the opening; and the supplied air being injected from a space between the tip of the filling cylinder and the air-injection cylinder, and flows along the inner surface of the discharge mouth.

2. The filling nozzle according to claim 1, wherein an inner surface of the air-discharge mouth is coated with a water-repellant layer.

3. The filling nozzle according to claim 1, further comprising a lifting unit for raising and lowering the air-injection cylinder relative to the filling cylinder, the lifting unit lowering the air-injection cylinder such that the tip of the air-injection cylinder is inserted into a container when the filling cylinder discharges powder from the opening to supply the powder into the container.

4. The filling nozzle according to claim 2, further comprising a lifting unit for raising and lowering the air-injection cylinder relative to the filling cylinder, the lifting unit lowering the air-injection cylinder such that the tip of the air-injection cylinder is inserted into a container when the filling cylinder discharges powder from the opening to supply the powder into the container.

* * * * *